US011508279B2

(12) United States Patent
Kim et al.

(10) Patent No.: US 11,508,279 B2
(45) Date of Patent: Nov. 22, 2022

(54) GATE DRIVING CIRCUIT, DISPLAY DEVICE AND METHOD FOR DRIVING DISPLAY DEVICE

(71) Applicant: LG DISPLAY CO., LTD., Seoul (KR)

(72) Inventors: Juwon Kim, Paju-si (KR); MooKyoung Hong, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/513,210

(22) Filed: Oct. 28, 2021

(65) Prior Publication Data

US 2022/0189368 A1 Jun. 16, 2022

(30) Foreign Application Priority Data

Dec. 10, 2020 (KR) ..... 10-2020-0172708

(51) Int. Cl.
*G09G 3/20* (2006.01)

(52) U.S. Cl.
CPC ..... *G09G 3/20* (2013.01); *G09G 2300/0842* (2013.01); *G09G 2310/0267* (2013.01); *G09G 2310/08* (2013.01); *G09G 2320/0295* (2013.01); *G09G 2320/043* (2013.01)

(58) Field of Classification Search
CPC ... G09G 2310/0267; G09G 2300/0842; G09G 2310/08; G09G 2320/043; G09G 2320/0295
See application file for complete search history.

(56) References Cited

U.S. PATENT DOCUMENTS 9,106,209 B2 * 8/2015 Kang ..... G09G 3/3677

* cited by examiner

*Primary Examiner* — Gerald Johnson
(74) *Attorney, Agent, or Firm* — Morgan, Lewis & Bockius LLP

(57) ABSTRACT

Embodiments of the present disclosure relate to a gate driving circuit, a display device, and a method for driving a display device. It is possible to reduce deterioration of the transistor controlled by a first QB node and a second QB node by alternately driving the first QB node and the second QB node of a gate circuit. In addition, by sensing a deterioration deviation between a transistor controlled by the first QB node and a transistor controlled by the second QB node and adjusting a driving period of the first QB node and a driving period of the second QB node based on the sensing result, it is possible to maximize or at least increase the lifetime of the transistor controlled by the first QB node and the transistor controlled by the second QB node, thereby improving the reliability of the gate circuit.

20 Claims, 15 Drawing Sheets

GATE DRIVING CIRCUIT, DISPLAY DEVICE AND METHOD FOR DRIVING DISPLAY DEVICE

CROSS REFERENCE TO RELATED APPLICATION

This application claims priority from Korean Patent Application No. 10-2020-0172708, filed on Dec. 10, 2020, which is hereby incorporated by reference for all purposes as if fully set forth herein.

BACKGROUND

Technical Field

The present disclosure relates to a gate driving circuit, a display device, and a method for driving a display device.

Discussion of the Related Art

The growth of the information society leads to increased demand for display devices to display images and use of various types of display devices, such as liquid crystal display devices, organic light emitting display devices, etc.

A display device may include a display panel in which a plurality of gate lines, a plurality of data lines, and a plurality of subpixels are disposed, and several driving circuits for driving the display panel. For example, the display device may include a gate driving circuit driving a plurality of gate lines, a data driving circuit driving the plurality of data lines, and a controller controlling the gate driving circuit and the data driving circuit.

The gate driving circuit may supply a scan signal to the gate line at a predetermined timing, and may control the driving timing of the subpixel connected to the gate line.

The gate driving circuit may include several circuit elements for outputting a scan signal. As the driving time of the gate driving circuit increases, there may be occurred deterioration of the circuit elements included in the gate driving circuit.

The scan signal may not be normally output due to deterioration of circuit elements included in the gate driving circuit. In addition, if an output abnormality of the scan signal occurs, an image displayed through the display panel may be abnormal.

Accordingly, there is a need for a method capable of improving the stability of the gate driving circuit and improving the lifespan and reliability of the gate driving circuit.

SUMMARY

Accordingly, embodiments of the present disclosure are directed to a gate driving circuit, a display device, and a method for driving a display device that substantially obviate one or more of the problems due to limitations and disadvantages of the related art.

An aspect of the present disclosure is to provide a method capable of reducing or delaying deterioration of circuit elements included in the gate driving circuit and improving the lifespan and reliability of the gate driving circuit.

Another aspect of the present disclosure is to provide a manner capable of maximizing the lifespan of the gate driving circuit by driving circuit elements included in the gate driving circuit according to an optimized driving method.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a display device comprises a plurality of subpixels disposed on a display panel, a plurality of gate lines electrically connected to a part of the plurality of subpixels, and a plurality of gate circuits for driving the plurality of gate lines.

Each of the plurality of gate circuits may include a pull-up transistor controlled by a Q node, a first pull-down transistor controlled by a first QB node, and a second pull-down transistor controlled by a second QB node.

The first QB node may be electrically connected to an input terminal of a first gate control voltage, and the second QB node may be electrically connected to an input terminal of a second gate control voltage.

In a first driving period, a length of a period in which the first gate control voltage is a driving level may be equal to a length of a period in which the second gate control voltage is the driving level.

In a second driving period, a length of a period in which the first gate control voltage is the driving level may be different from a length of a period in which the second gate control voltage is the driving level.

In the first driving period, an amount of current flowing through a line supplied with the first gate control voltage during the period in which the first gate control voltage is the driving level may be greater than an amount of current flowing through a line supplied with the second gate control voltage during the period in which the second gate control voltage is the driving level, and, in the second driving period, the length of the period in which the first gate control voltage is the driving level may be smaller than the length of the period in which the second gate control voltage is the driving level.

Alternatively, in the first driving period, an amount of current flowing through a line supplied with the first gate control voltage during the period in which the first gate control voltage is the driving level may be smaller than an amount of current flowing through a line supplied with the second gate control voltage during the period in which the second gate control voltage is the driving level, and, in the second driving period, the length of the period in which the first gate control voltage is the driving level may be greater than the length of the period in which the second gate control voltage is the driving level.

In another aspect, a method for driving a display device comprises a step of supplying a first gate control voltage of a driving level to a gate driving circuit during a part of a first driving period and supplying a second gate control voltage of a driving level to the gate driving circuit during the remaining period of the first driving period, a step of measuring a first amount of current flowing through a line supplied with the first gate control voltage during a period in which the first gate control voltage is at the driving level in the first driving period, a step of measuring a second amount of current flowing through a line supplied with the second gate control voltage during a period in which the second gate control voltage is at the driving level in the first driving period, and a step of adjusting, based on a comparison result of the first amount of current and the second amount of current, a length of a period in which the first gate control voltage supplied to the gate driving circuit is at a driving level and a length of a period in which the second gate control voltage is at a driving level in a second driving period after the first driving period.

The method for driving a display device may further include a step of measuring a third amount of current flowing through a line supplied with the first gate control voltage during a period in which the first gate control voltage is at the driving level in the second driving period, and a step of measuring a fourth amount of current flowing through a line supplied with the second gate control voltage during a period in which the second gate control voltage is at the driving level in the second driving period.

A difference between the third amount of current and the fourth amount of current may be less than or equal to a difference between the first amount of current and the second amount of current.

In another aspect, a gate driving circuit comprises a first gate circuit including a pull-up transistor controlled by a Q1 node, a first pull-down transistor controlled by a first QB node, and a second pull-down transistor controlled by a second QB node.

The gate driving circuit may further include a second gate circuit including a pull-up transistor controlled by a Q2 node, a first pull-down transistor controlled by the first QB node, and a second pull-down transistor controlled by the second QB node.

The first QB node may be controlled by a first gate control voltage, and the second QB node may be controlled by a second gate control voltage.

A period in which the first gate control voltage is at a driving level and a period in which the second gate control voltage is at a driving level may alternate.

According to embodiments of the present disclosure, it is possible to reduce stress applied to a first pull-down transistor and a second pull-down transistor by disposing in the gate circuit the first pull-down transistor controlled by a first QB node and the second pull-down transistor controlled by a second QB node, and alternately driving the first QB node and the second QB node.

According to embodiments of the present disclosure, it is possible to maximize or at least increase the lifetime of the first pull-down transistor and the second pull-down transistor and improve the reliability of the gate circuit by monitoring deterioration of the first pull-down transistor and the second pull-down transistor and adjusting the driving period of the first QB node and the driving period of the second QB node.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles.

DETAILED DESCRIPTION

Figure 1:
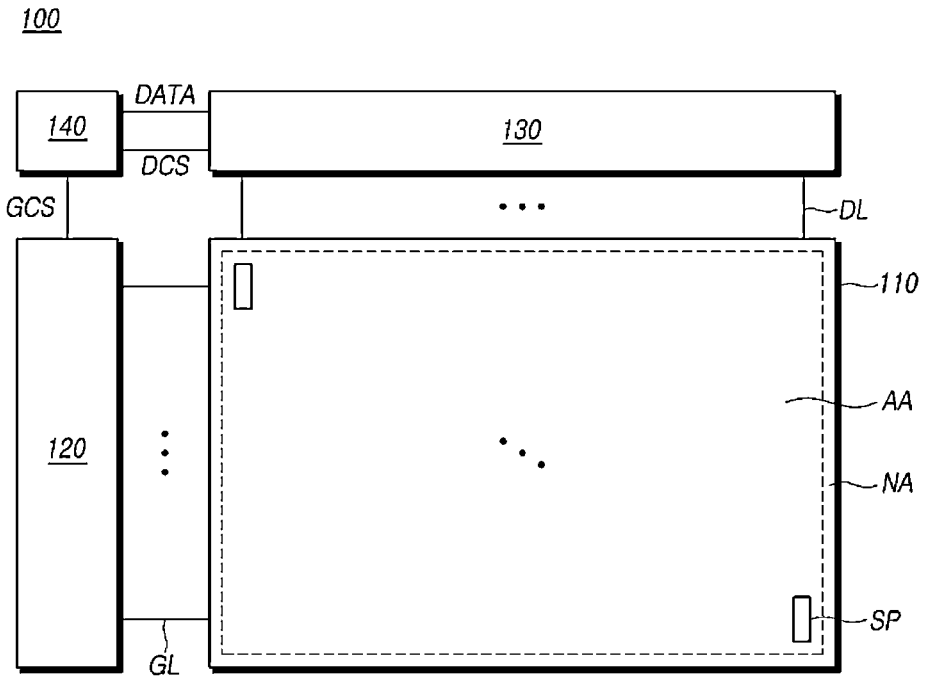
FIG. 1 schematically illustrates a configuration of a display device according to embodiments of the present disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 schematically illustrates a configuration included in a display device 100 according to embodiments of the present disclosure.

Referring to FIG. 1, the display device 100 may include a display panel 110, a gate driving circuit 120 for driving the display panel 110, a data driving circuit 130, a controller 140, or the like.

The display panel 110 may include an active area AA in which a plurality of subpixels SP are disposed, and a non-active area NA positioned outside the active area AA.

A plurality of gate lines GL and a plurality of data lines DL may be disposed on the display panel 110. The subpixel SP may be positioned in a region where the gate line GL and the data line DL intersect.

The gate driving circuit 120 is controlled by the controller 140. The gate driving circuit 120 can sequentially output scan signals to the plurality of gate lines GL arranged on the display panel 110, thereby controlling the driving timing of the plurality of subpixels SP.

The gate driving circuit 120 may include one or more gate driver integrated circuits GDIC. The gate driving circuit 120 may be located only at one side of the display panel 110, or can be located at both sides thereof according to a driving method.

Each gate driver integrated circuit GDIC may be connected to a bonding pad of the display panel 110 by a tape automated bonding (TAB) method or a chip-on-glass (COG) method. Alternatively, each gate driver integrated circuit GDIC may be implemented as a gate-in-panel (GIP) type and disposed directly on the display panel 110. Alternatively, each gate driver integrated circuit GDIC may be integrated and disposed on the display panel 110 in some cases. Alternatively, each gate driver integrated circuit GDIC may be implemented in a chip-on-film (COF) method mounted on a film connected to the display panel 110.

The data driving circuit 130 may receive data signal from the controller 140 and converts the data signal into an analog data voltage Vdata. The data driving circuit 130 outputs the data voltage Vdata to each data line DL according to the timing at which the scan signal is applied through the gate line GL so that each of the plurality of subpixels SP emits light having brightness according to the data signal.

The data driving circuit 130 may include one or more source driver integrated circuits SDIC.

Each source driver integrated circuit SDIC may include a shift register, a latch circuit, a digital-to-analog converter, an output buffer, and the like.

Each source driver integrated circuit SDIC may be connected to a bonding pad of the display panel 110 by a tape automated bonding (TAB) method or a chip-on-glass (COG) method. Alternatively, each source driver integrated circuit SDIC may be disposed directly on the display panel 110. Alternatively, each source driver integrated circuit SDIC may be integrated and disposed on the display panel 110 in some cases. Alternatively, each source driver integrated circuit SDIC may be implemented in a chip-on-film (COF) manner. In this case, each source driver integrated circuit SDIC may be mounted on a film connected to the display panel 110, and may be electrically connected to the display panel 110 through lines on the film.

The controller 140 may supply various control signals to the gate driving circuit 120 and the data driving circuit 130, and control the operation of the gate driving circuit 120 and the data driving circuit 130.

The controller 140 may be mounted on a printed circuit board or a flexible printed circuit. The controller 140 may be electrically connected to the gate driving circuit 120 and the data driving circuit 130 through a printed circuit board or a flexible printed circuit.

The controller 140 may control the gate driving circuit 120 to output a scan signal according to timing implemented in each frame. The controller 140 may convert externally received image data to match a signal format used by the data driving circuit 130, and output the converted data signal to the data driving circuit 130.

The controller 140 may receive various timing signals including a vertical synchronization signal VSYNC, a horizontal synchronization signal HSYNC, an input data enable signal DE, a clock signal CLK from the outside (e.g., host system).

The controller 140 may generate various control signals by using various timing signals received from the outside, and may output the control signals to the gate driving circuit 120 and the data driving circuit 130.

For example, in order to control the gate driving circuit 120, the controller 140 may output various gate control signals GCS including a gate start pulse GSP, a gate shift clock GSC, and a gate output enable signal GOE.

The gate start pulse GSP controls operation start timing of one or more gate driver integrated circuits GDIC constituting the gate driving circuit 120. The gate shift clock GSC, which is a clock signal commonly input to one or more gate driver integrated circuits GDIC, controls the shift timing of a scan signal. The gate output enable signal GOE specifies timing information on one or more gate driver integrated circuits GDIC.

In addition, in order to control the data driving circuit 130, the controller 140 may output various data control signals DCS including a source start pulse SSP, a source sampling clock SSC, a source output enable signal SOE, or the like.

The source start pulse SSP controls a data sampling start timing of one or more source driver integrated circuits SDIC constituting the data driving circuit 130. The source sampling clock SSC is a clock signal for controlling the timing of sampling data in the respective source driver integrated circuits SDIC. The source output enable signal SOE controls the output timing of the data driving circuit 130.

The display device 100 may further include a power management integrated circuit (not shown) for supplying various voltages or currents to the display panel 110, the gate driving circuit 120, the data driving circuit 130, and the like or controlling various voltages or currents to be supplied thereto.

Each subpixel SP may be a region defined by the intersection of the gate line GL and the data line DL, in which at least one circuit element including a light emitting device may be disposed.

For example, in the case that the display device 100 is a liquid crystal display device, the display panel 110 may include a liquid crystal layer. In addition, the arrangement of the liquid crystal may be adjusted according to the electric field formed by each of the plurality of subpixels SP, the brightness of the subpixels SP may be adjusted, and an image may be displayed.

As another example, in the case that the display device 100 is an organic light emitting display device, an organic light emitting diode OLED and various circuit elements may be disposed in the plurality of subpixels SP. The display device 100 controls the current supplied to the organic light emitting diode OLED disposed in the subpixel SP by driving several circuit elements, so that each subpixel SP may be controlled to display brightness corresponding to image data.

Alternatively, in some cases, a light emitting diode (LED) or a micro light emitting diode (μLED) may be disposed in the subpixel SP.

Figure 2:
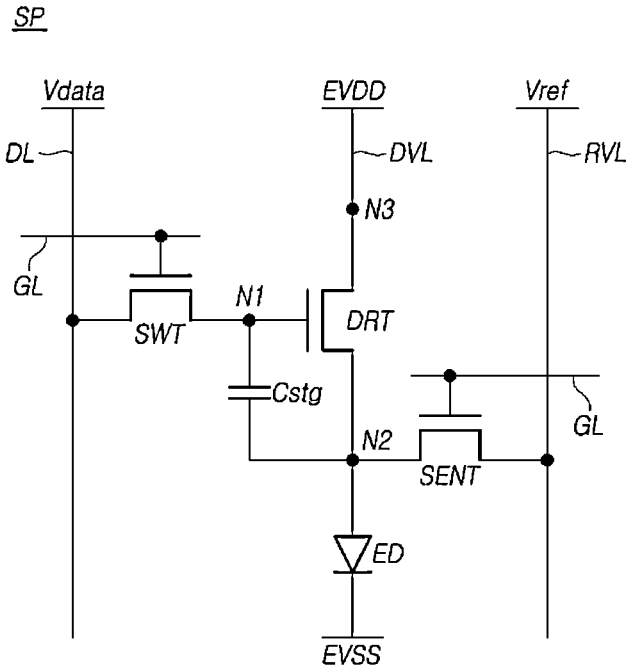
FIG. 2 illustrates an example of a circuit structure of a subpixel included in a display device according to embodiments of the present disclosure.

FIG. 2 illustrates an example of a circuit structure of the subpixel SP included in the display device 100 according to embodiments of the present disclosure.

FIG. 2 illustrates an example of a circuit structure of a subpixel SP in the case that the display device 100 is an organic light emitting display device, but embodiments of the present disclosure may be applied to other types of display devices.

Referring to FIG. 2, a light emitting device ED and a driving transistor DRT for driving the light emitting device ED may be disposed in the subpixel SP. In addition, at least one circuit element other than the light emitting element ED and the driving transistor DRT may be further disposed in the subpixel SP.

For example, as illustrated in FIG. 2, a switching transistor SWT, a sensing transistor SENT, and a storage capacitor Cstg may be further disposed in the subpixel SP.

Accordingly, the example of FIG. 2 illustrates a 3T-1C structure in which three thin film transistors and one capacitor are disposed in addition to the light emitting device ED in the subpixel SP as an example, but embodiments of the present disclosure is not limited thereto. Further, FIG. 2 illustrates the example in which the thin film transistors are all N-type, but in some cases, the thin film transistors disposed in the subpixel SP may be P-type.

The switching transistor SWT may be electrically connected between the data line DL and a first node N1.

The data voltage Vdata may be supplied to the subpixel SP through the data line DL. The first node N1 may be a gate node of the driving transistor DRT.

The switching transistor SWT may be controlled by a scan signal supplied to the gate line GL. The switching transistor SWT may control that the data voltage Vdata supplied through the data line DL is applied to the gate node of the driving transistor DRT.

The driving transistor DRT may be electrically connected between the driving voltage line DVL and the light emitting device ED.

The light emission high potential driving voltage EVDD may be supplied to the third node N3 through the driving voltage line DVL. The third node N3 may be a drain node or a source node of the driving transistor DRT.

The driving transistor DRT may be controlled by a voltage applied to the first node N1. In addition, the driving transistor DRT may control the driving current supplied to the light emitting device ED.

The sensing transistor SENT may be electrically connected between a reference voltage line RVL and a second node N2.

The reference voltage Vref may be supplied to the second node N2 through the reference voltage line RVL. The second node N2 may be a source node or a drain node of the driving transistor DRT.

The sensing transistor SENT may be controlled by a scan signal supplied to the gate line GL. The gate line GL controlling the sensing transistor SENT may be the same as or different from the gate line GL controlling the switching transistor SWT.

The sensing transistor SENT may control that the reference voltage Vref is applied to the second node N2. Also, in some cases, the sensing transistor SENT may control sensing the voltage of the second node N2 through the reference voltage line RVL.

The storage capacitor Cstg may be electrically connected between the first node N1 and the second node N2. The storage capacitor Cstg may maintain the data voltage Vdata applied to the first node N1 for one frame.

The light emitting device ED may be electrically connected between the second node N2 and a line to which the light emission low potential driving voltage EVSS is supplied.

If a scan signal of a turn-on level is applied to the gate line GL, the switching transistor SWT and the sensing transistor SENT may be turned on. The data voltage Vdata may be applied to the first node N1, and the reference voltage Vref may be applied to the second node N2.

A driving current supplied by the driving transistor DRT may be determined according to a difference between the voltage of the first node N1 and the voltage of the second node N2.

The light emitting device ED may exhibit brightness according to the driving current supplied through the driving transistor DRT.

As described above, the driving timing of the subpixels SP disposed on the display panel 110 is controlled according to the scan signal supplied through the gate line GL thereby representing the brightness according to the data voltage Vdata and displaying an image.

The gate driving circuit 120 may output the scan signal to the plurality of gate lines GL, and may include a plurality of gate circuits for controlling each of the plurality of gate lines GL.

Figure 3A:
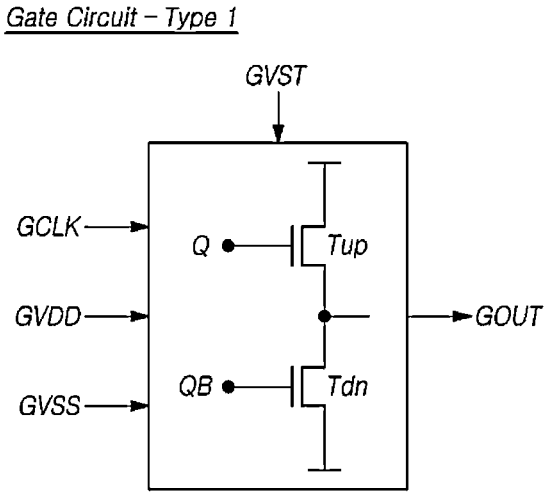
FIGS. 3A and 3B illustrate examples of a structure of a gate circuit included in a gate driving circuit according to embodiments of the present disclosure.
Figure 3B:
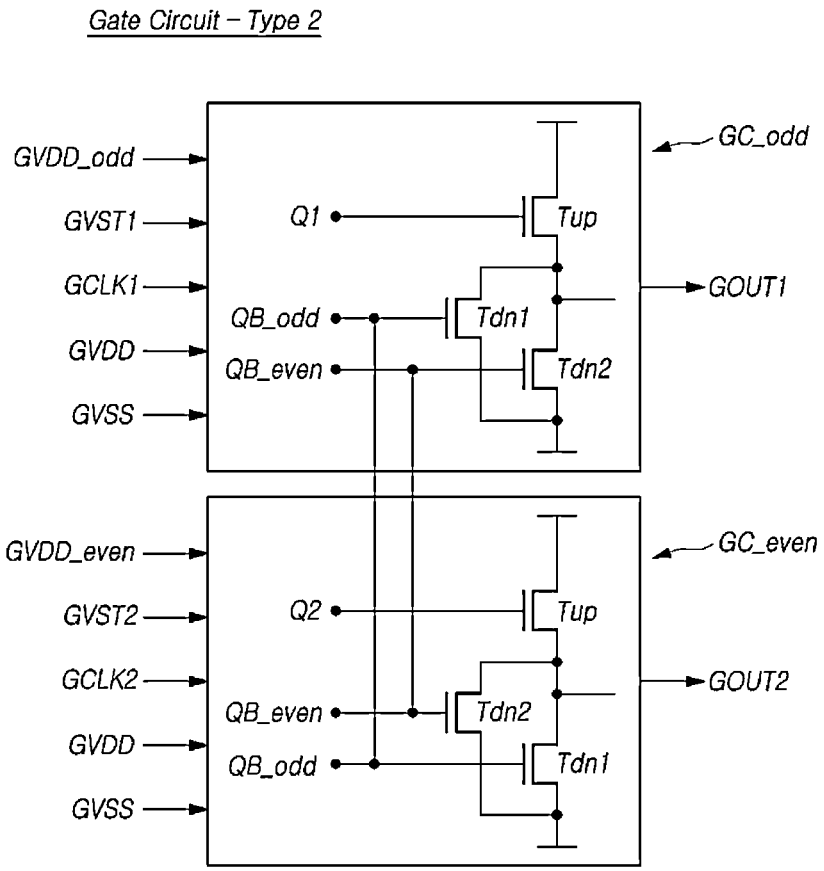

FIGS. 3A and 3B illustrate examples of a structure of a gate circuit included in a gate driving circuit 120 according to embodiments of the present disclosure.

Referring to FIG. 3A, the gate circuit may include a pull-up transistor Tup controlled by a Q node and a pull-down transistor Tdn controlled by a QB node. The pull-up transistor Tup may control an output of a scan signal of a turn-on level, and the pull-down transistor Tdn may control an output of a scan signal of a turn-off level.

The gate circuit may include a plurality of transistors and at least one capacitor for controlling the voltage level of the Q node and the voltage level of the QB node.

The gate circuit may receive various signals and voltages, and may output a scan signal according to driving of the pull-up transistor Tup and the pull-down transistor Tdn by the Q node and the QB node.

For example, the gate circuit may receive a gate start signal GVST and at least one gate clock signal GCLK for controlling the driving timing. The gate start signal GVST may be a carry signal output from another gate circuit.

The gate circuit may receive one or more driving voltages, and may receive a gate driving voltage GVDD and a gate base voltage GVSS. For example, the gate driving voltage GVDD may be a high potential driving voltage and the gate base voltage GVSS may be a low potential driving voltage.

The gate circuit may control the Q node and the QB node according to various signals and voltages inputted, and output the gate signal at a predetermined timing.

For example, during a period in which the Q node included in the gate circuit is at a turn-on level, the pull-up transistor Tup may be turned on, and a gate signal of the turn-on level may be output.

Further, during the period in which the Q node is at a turn-off level, the QB node may become a turn-on level. In a period in which the QB node is at the turn-on level, the pull-down transistor Tdn may be turned on, and a gate signal of the turn-off level may be output.

During the driving period of the gate circuit, the period in which the QB node is at the turn-on level may be longer than the period in which the Q node is at the turn-on level. Accordingly, the stress applied to the pull-down transistor Tdn controlled by the QB node may be large.

In order to reduce deterioration of the pull-down transistor Tdn due to stress, the gate circuit may include two or more pull-down transistors Tdn. The gate circuit may control the output of the turn-off level gate signal using two or more pull-down transistors Tdn.

Referring to FIG. 3B, the gate driving circuit 120 may include, for example, a plurality of first gate circuits GC_odd and a plurality of second gate circuits GC_even. FIG. 3B illustrates an example of a schematic structure of one first gate circuit GC_odd and one second gate circuit GC_even. Each of the first gate circuit GC_odd and the second gate circuit GC_even may be a gate circuit that drives a separate gate line GL. In order to explain the characteristics of the structure of the gate circuit, FIG. 3B illustrates a plurality of gate circuits, and the gate driving circuit 120 composed of the gate circuit shown in FIG. 3A and the gate driving circuit 120 composed of the gate circuit shown in FIG. 3B may include the same number of gate circuits.

The first gate circuit GC_odd may include a pull-up transistor Tup controlled by a Q1 node. The first gate circuit GC_odd may include a first pull-down transistor Tdn1 controlled by a first QB node QB_odd. The first gate circuit GC_odd may include a second pull-down transistor Tdn2 controlled by a second QB node QB_even.

The first gate circuit GC_odd may receive a first gate start signal GVST1, a first gate clock signal GCLK1, a gate driving voltage GVDD, and a gate base voltage GVSS.

The first gate circuit GC_odd may receive a first gate control voltage GVDD_odd. The first gate control voltage GVDD_odd may be a voltage that controls driving of the first QB node QB_odd.

The second gate circuit GC_even may include a pull-up transistor Tup controlled by a Q2 node. The second gate circuit GC_even may include a first pull-down transistor Tdn1 controlled by a first QB node QB_odd. The second gate circuit GC_even may include a second pull-down transistor Tdn2 controlled by a second QB node QB_even.

The second gate circuit GC_even may receive a second gate start signal GVST2, a second gate clock signal GCLK2, the gate driving voltage GVDD, and the gate base voltage GVSS.

The second gate circuit GC_even may receive a second gate control voltage GVDD_even. The second gate control voltage GVDD_even may be a voltage that controls driving of the second QB node QB_even.

Each of the first gate circuit GC_odd and the second gate circuit GC_even utilizes the first pull-down transistor Tdn1 and the second pull-down transistor Tdn2 to control the output of a gate signal of a turn-off level.

The first gate circuit GC_odd and the second gate circuit GC_even may share the first QB node QB_odd that controls the first pull-down transistor Tdn1.

The first gate circuit GC_odd and the second gate circuit GC_even may share the second QB node QB_even that controls the second pull-down transistor Tdn2.

The first QB node QB_odd may be at the turn-on level during a period in which the first gate control voltage GVDD_odd input to the first gate circuit GC_odd is the driving level. There may be controlled the output of the gate signal of the turn-off level by the first pull-down transistor Tdn1 included in the first gate circuit GC_odd and the first pull-down transistor Tdn1 included in the second gate circuit GC_even.

In a period in which the first gate control voltage GVDD_odd is the driving level, the second gate control voltage GVDD_even may be at a non-driving level. In a period in which the second gate control voltage GVDD_even is the driving level, the first gate control voltage GVDD_odd may be at the non-driving level.

As an example, the driving level may mean a high level, and the non-driving level may mean a low level, but is not limited thereto.

The second QB node QB_even may be at the turn-on level during a period in which the second gate control voltage GVDD_even input to the second gate circuit GC_even is at the driving level. There may be controlled the output of a gate signal of a turn-off level by the second pull-down transistor Tdn2 included in the first gate circuit GC_odd and the second pull-down transistor Tdn2 included in the second gate circuit GC_even.

The stress applied to the first pull-down transistor Tdn1 and the second pull-down transistor Tdn2 may be reduced by driving the first QB node QB_odd or the second QB node QB_even to control the output of the gate signal of the turn-off level.

Figure 4A:
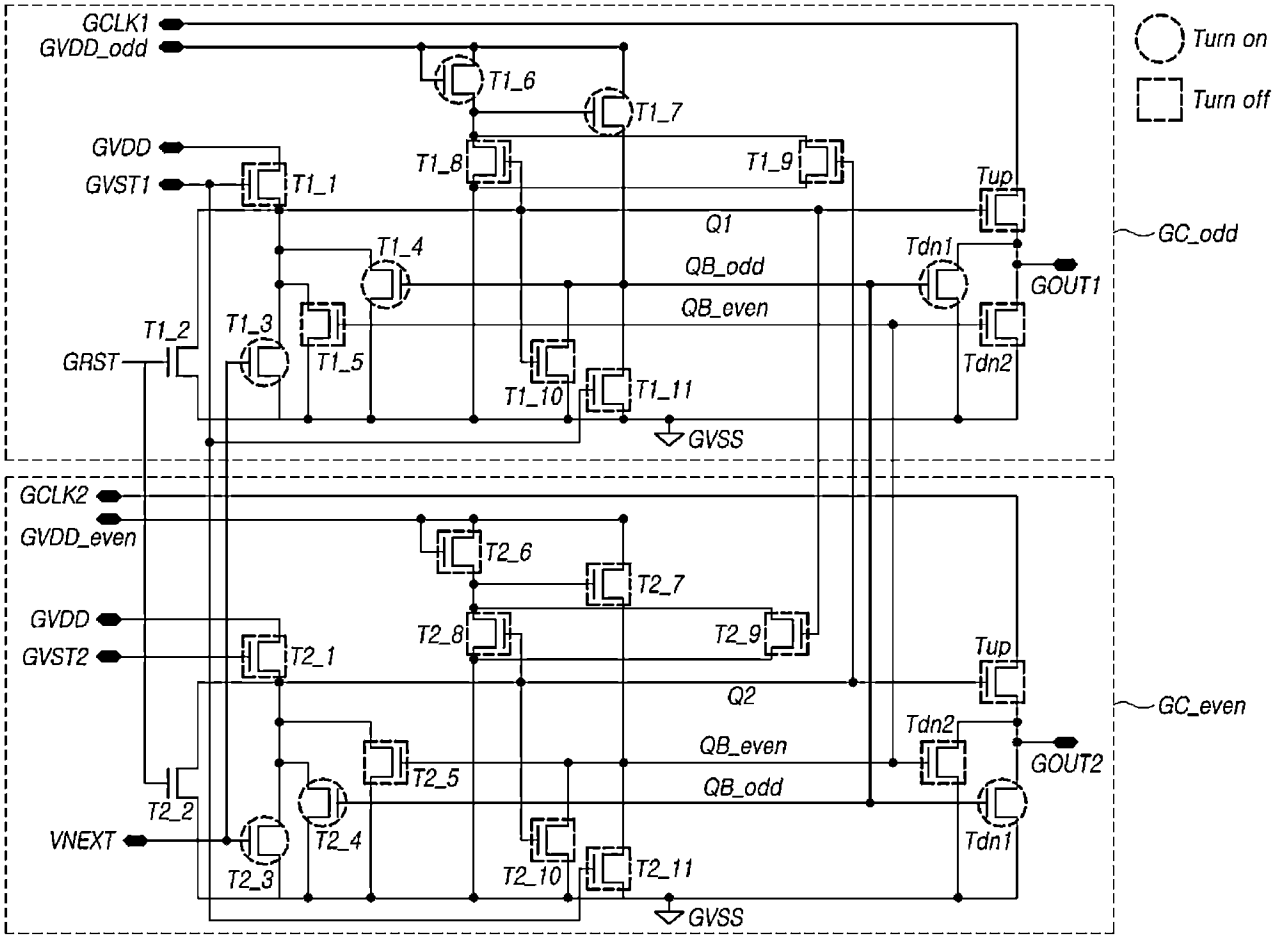
FIGS. 4A and 4B illustrate a specific structure and driving timing of the gate circuit shown in FIG. 3B.
Figure 4B:
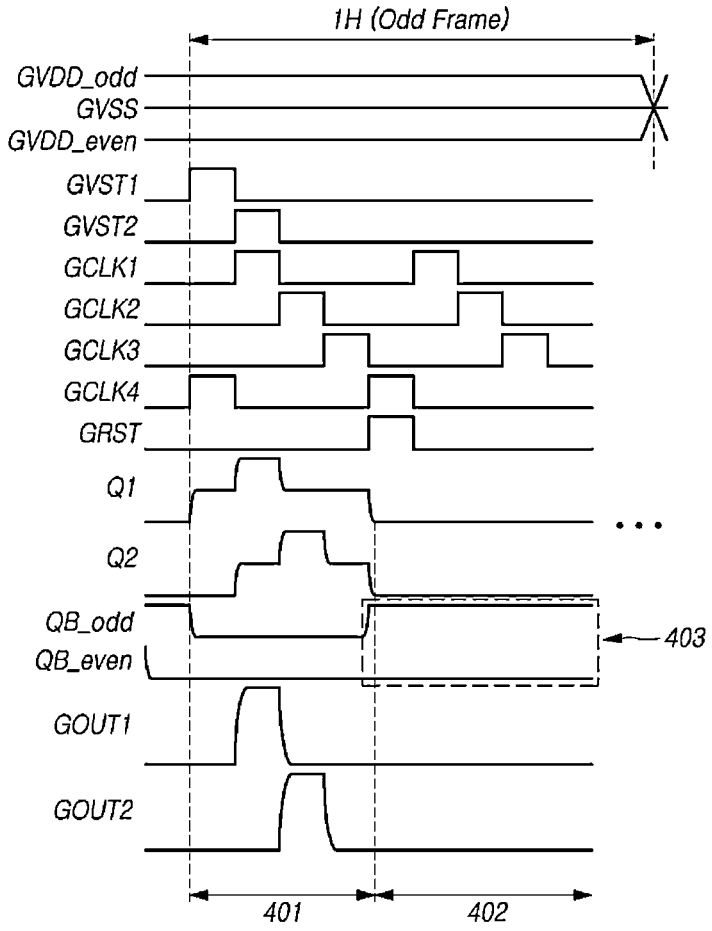

FIGS. 4A and 4B illustrate a specific structure and driving timing of the gate circuit shown in FIG. 3B.

Referring to FIG. 4A, the first gate circuit GC_odd may include a plurality of transistors T1_1, T1_2, T1_3, T1_4, T1_5, T1_6, T1_7, T1_8, T1_9, T1_10 and T1_11 in addition to the pull-up transistor Tup, the first pull-down transistor Tdn1, and the second pull-down transistor Tdn2. In addition, in some cases, the first gate circuit GC_odd may include at least one capacitor.

A first transistor T1_1 may be controlled by a first gate start signal GVST1. The first transistor T1_1 may be electrically connected between an input terminal of the gate driving voltage GVDD and the Q1 node.

A second transistor T1_2 may be controlled by a gate reset signal GRST. The second transistor T1_2 may be electrically connected between the Q1 node and an input terminal of the gate ground voltage GVSS.

A third transistor T1_3 may be controlled by a carry signal VNEXT output from the next gate circuit. The third transistor T1_3 may be electrically connected between the Q1 node and the input terminal of the gate ground voltage GVSS.

A fourth transistor T1_4 may be controlled by the first QB node QB_odd. The fourth transistor T1_4 may be electrically connected between the Q1 node and the input terminal of the gate ground voltage GVSS. Since the fourth transistor T1_4 is controlled by the first QB node QB_odd, it may be stressed during a period in which the first QB node QB_odd is driven.

A fifth transistor T1_5 may be controlled by the second QB node QB_even. The fifth transistor T1_5 may be electrically connected between the Q1 node and the input terminal of the gate ground voltage GVSS. Since the fifth transistor T1_5 is controlled by the second QB node QB_even, the fifth transistor T1_5 may be stressed during a period in which the second QB node QB_even is driven.

A sixth transistor T1_6 may be controlled by the first gate control voltage GVDD_odd. The sixth transistor T1_6 may be electrically connected between the input terminal of the first gate control voltage GVDD_odd and a gate node of a seventh transistor T1_7.

The seventh transistor T1_7 may be electrically connected between the input terminal of the first gate control voltage GVDD_odd and the first QB node QB_odd.

During the period in which the first gate control voltage GVDD_odd is the driving level, the sixth transistor T1_6 and the seventh transistor T1_7 are turned on, and the first gate control voltage GVDD_odd of the driving level may be applied to the first QB node.

A eighth transistor T1_8 may be controlled by the Q1 node. The eighth transistor T1_8 may be electrically connected between the gate node of the seventh transistor T1_7 and the input terminal of the gate ground voltage GVSS.

A ninth transistor T1_9 may be controlled by the Q2 node. The ninth transistor T1_9 may be electrically connected between a source node and a drain node of the eighth transistor T1_8.

A tenth transistor T1_10 may be controlled by the Q1 node. The tenth transistor T1_10 may be electrically connected between the first QB node QB_odd and the input terminal of the gate ground voltage GVSS.

The eleventh transistor T1_11 may be controlled by a first gate start signal GVST1. The eleventh transistor T1_11 may be electrically connected between the first QB node QB_odd and the input terminal of the gate ground voltage GVSS.

Accordingly, there may be controlled the discharge of the first QB node QB_odd by the tenth transistor T1_10 and the eleventh transistor T1_11.

In addition, since the first QB node QB_odd of the first gate circuit GC_odd is to electrically connected to the first QB node QB_odd of the second gate circuit GC_even, there may be controlled the discharge of the first QB node QB_even of the second gate circuit GC_even by the tenth transistor T1_10 and the eleventh transistor T1_11 of the first gate circuit GC_odd.

The second gate circuit GC_even may include, similar to the first gate circuit GC_odd, a plurality of transistors T2_1, T2_2, T2_3, T2_4, T2_5, T2_6, T2_7, T2_8, T2_9, T2_10, and T2_11 in addition to a pull-up transistor Tup, a first pull-down transistor Tdn1 and a second pull-down transistor Tdn2.

The plurality of transistors T2_1, T2_2, T2_3, T2_4, T2_5, T2_6, T2_7, T2_8, T2_9, T2_10, and T2_11 included in the second gate circuit GC_even have a connection structure similar to that of the plurality of transistors T1_1, T1_2, T1_3, T1_4, T1_5, T1_6, T1_7, T1_8, T1_9, T1_10 and T1_11 included in the first gate circuit GC_odd. Therefore, it will be omitted the duplicate description.

The second gate circuit GC_even may receive a second gate control voltage GVDD_even.

A sixth transistor T2_6 and a seventh transistor T2_7 of the second gate circuit GC_even may be turned on during a period in which the second gate control voltage GVDD_even is the driving level. Accordingly, the second gate control voltage GVDD_even of the driving level may be applied to the second QB node QB_even.

There may be controlled the discharge of the second QB node QB_even by a tenth transistor T2_10 and a eleventh transistor T2_11 of the second gate circuit GC_even.

The second pull-down transistor Tdn2 and a fifth transistor T2_5 of the second gate circuit GC_even may be stressed during a period in which the second QB node QB_even is driven.

The first pull-down transistor Tdn1 and a fourth transistor T2_4 of the second gate circuit GC_even may be stressed in a period in which the first QB node QB_odd is driven.

FIGS. 4A and 4B illustrate an example of driving states of transistors included in the first gate circuit GC_odd and the second gate circuit GC_even during a period in which the first gate control voltage GVDD_odd is the driving level and the second gate control voltage GVDD_even is the non-driving level.

Referring to FIGS. 4A and 4B, in a frame period in which the first gate control voltage GVDD_odd is the driving level, the first gate circuit GC_odd may output a first gate signal GOUT1 according to the input timing of a first gate start signal GVST1. When the first gate start signal GVST1 is input, the Q1 node may be at a turn-on level, and the first QB node QB_odd may be at a turn-off level. Thereafter, the first gate signal GOUT1 may be output according to the timing at which a first gate clock signal GCLK1 is input. In addition, the second gate circuit GC_even may output a second gate signal GOUT2 according to the input timing of a second gate start signal GVST2. When the second gate start signal GVST2 is input, the Q2 node may be at a turn-on level. The first QB node QB_odd may be in a state of maintaining a turn-off level. The second gate signal GOUT2 may be output according to the timing at which a second gate clock signal GCLK2 is input.

FIG. 4B illustrates an example of driving timings of the first gate circuit GC_odd and the second gate circuit GC_even during one frame period in which the first gate control voltage GVDD_odd is the driving level. The period in which the first gate control voltage GVDD_odd is the driving level and the period in which the second gate control voltage GVDD_even is the driving level may alternate at regular intervals. For example, the period in which the first gate control voltage GVDD_odd is the driving level and the period in which the second gate control voltage GVDD_even is the driving level may alternate in each frame period 1H. The period in which the first gate control voltage GVDD_odd is at the driving level may be referred to as an "Odd Frame", and the period in which the second gate control voltage GVDD_even is at the driving level may be referred to as an "Even Frame".

The period indicated by 401 in FIG. 4B represents a period in which the Q1 node is at the turn-on level. During the corresponding period, the first gate signal GOUT1 may be output. Also, the period indicated by 401 may include a period in which the Q2 node becomes a turn-on level. During the corresponding period, the second gate signal GOUT2 may be output. During the corresponding period, the first QB node QB_odd and the second QB node QB_even may be at a turn-off level.

The period indicated by 402 in FIG. 4B represents a period in which the Q1 node and the Q2 node become at the turn-off level after the gate signal is output. During the corresponding period, one of the first QB node QB_odd and the second QB node QB_even may be at the turn-on level.

Since the example shown in FIG. 4B represents a period in which the first gate control voltage GVDD_odd is at the driving level, as indicated by 403, the first QB node QB_odd may be at the turn-on level, and the second QB node QB_even may maintain the turn-off level.

Accordingly, after the gate signal is output, there may be stressed the fourth transistor T1_4 and the first pull-down transistor Tdn1 of the first gate circuit GC_odd controlled by the first QB node QB_odd.

In addition, there may be stressed the fourth transistor T2_4 and the first pull-down transistor Tdn1 of the second gate circuit GC_even controlled by the first QB node QB_odd.

The gate circuit according to the embodiments of the present disclosure may alternately drive the first QB node QB_odd and the second QB node QB_even thereby reducing the stress applied to the first pull-down transistor Tdn1 and the fourth transistors T1_4 and T2_4.

Figure 5:
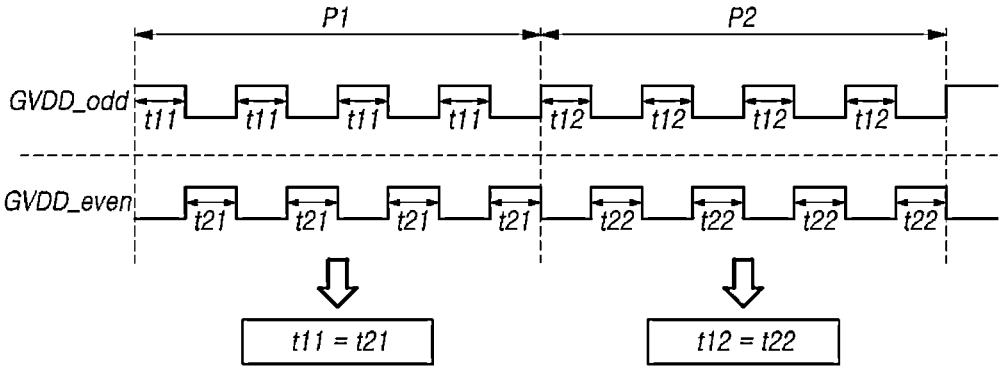
FIG. 5 illustrates an example of a driving method of the gate circuit shown in FIG. 3B.

FIG. 5 illustrates an example of a driving method of the gate circuit shown in FIG. 3B.

Referring to FIG. 5, a period in which the first gate control voltage GVDD_odd is the driving level and a period in which the second gate control voltage GVDD_even is the driving level may be alternated.

For example, in a first driving period P1, the first gate control voltage GVDD_odd may be at the driving level during a period corresponding to t11. In the corresponding period, the second gate control voltage GVDD_even may be at a non-driving level.

After the period in which the first gate control voltage GVDD_odd is the driving level, the second gate control voltage GVDD_even may be the driving level during the period corresponding to t21. In the corresponding period, the first gate control voltage GVDD_odd may be at the non-driving level.

In the first driving period P1, the period t11 in which the first gate control voltage GVDD_odd is the driving level may be the same as the period t21 in which the second gate control voltage GVDD_even is the driving level.

In addition, in the first driving period P1, the sum of the periods in which the first gate control voltage GVDD_odd is the driving level may be equal to the sum of the periods in which the second gate control voltage GVDD_even is the driving level.

Since the first QB node QB_odd is driven in a period in which the first gate control voltage GVDD_odd is at the driving level, the first pull-down transistor Tdn1 and the fourth transistors T1_4 and T2_4 may be in a state of stress. In addition, the second pull-down transistor Tdn2 and the fifth transistors T1_5 and T2_5 may be in a rest state.

Since the second QB node QB_even is driven in a period in which the second gate control voltage GVDD_even is at the driving level, the second pull-down transistor Tdn2 and the fifth transistors T1_5 and T2_5 may be in a state of stress. In addition, the first pull-down transistor Tdn1 and the fourth transistors T1_4 and T2_4 may be in a rest state.

Since the period in which the first gate control voltage GVDD_odd is the driving level and the period in which the second gate control voltage GVDD_even is the driving level are alternated, the stress caused by the first QB node QB_odd and the second QB node QB_even can be reduced.

The period in which the first gate control voltage GVDD_odd is the driving level and the period in which the second gate control voltage GVDD_even is the driving level may be repeated at regular intervals.

In a second driving period P2, the length t12 of the period in which the first gate control voltage GVDD_odd is the driving level may be the same as the length t22 of the period in which the second gate control voltage GVDD_even is the driving level.

In a second driving period P2, the sum of the lengths of the periods in which the first gate control voltage GVDD_odd is the driving level may be equal to the sum of the lengths of the periods in which the second gate control voltage GVDD_even is the driving level have.

The driving period of the first QB node QB_odd is equal to the driving period of the second QB node QB_even, so that it is possible to increase the lifetime of the transistor driven by the first QB node QB_odd and the transistor driven by the second QB node QB_even.

In addition, in the embodiments of the present disclosure, based on the difference between a characteristics of the transistor driven by the first QB node QB_odd and a characteristics of the transistor driven by the second QB node QB_even, the driving period of the first QB node QB_odd and the driving period of the second QB node QB_even may be varied.

Accordingly, there may provide a method for maximizing the lifetime of the transistor driven by the first QB node QB_odd and the transistor driven by the second QB node QB_even.

Figure 6A:
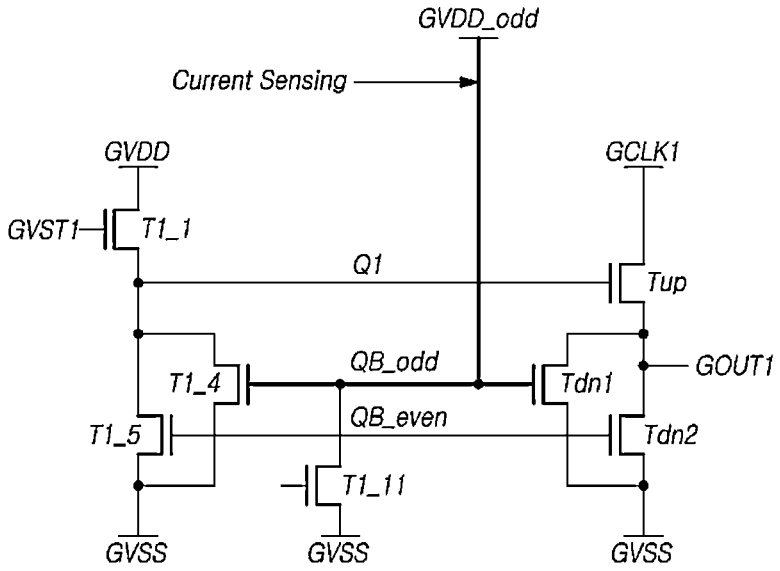
FIGS. 6A and 6B illustrate examples of a method of sensing deterioration of a device included in the gate circuit shown in FIG. 3B.
Figure 6B:
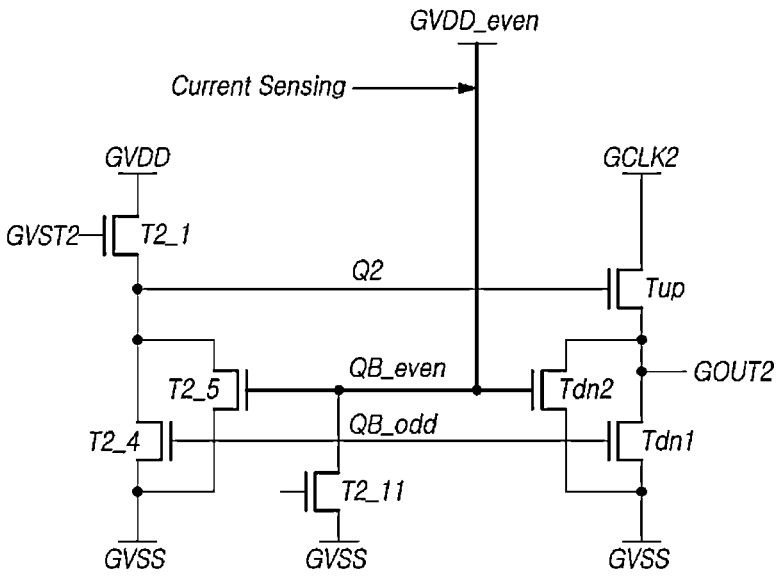

FIGS. 6A and 6B illustrate examples of a method of sensing deterioration of a device included in the gate circuit shown in FIG. 3B.

Referring to FIG. 6A, it is illustrated an example of a method of sensing deterioration of the first pull-down transistor Tdn1 and the fourth transistor T1_4 included in the first gate circuit GC_odd during a period in which the first gate control voltage GVDD_odd is at the driving level.

In addition, although FIG. 6A illustrates sensing of deterioration of a device included in the first gate circuit GC_odd as an example, there may be sensed the deterioration of devices controlled by the first QB node QB_odd driven by the first gate control voltage GVDD_odd according to this sensing method.

There may be measured an amount of current of a line supplied with the first gate control voltage GVDD_odd during a period in which the first gate control voltage GVDD_odd is at the driving level.

The amount of current of the line supplied with the first gate control voltage GVDD_odd may be measured, for example, during a period in which the display device 100 performs display driving. Alternatively, the amount of current of the line supplied with the first gate control voltage GVDD_odd may be measured during a period in which the display device 100 senses deterioration of a device or an element disposed in the subpixel SP.

In the case that the first pull-down transistor Tdn1 and the fourth transistor T1_4 deteriorate, the threshold voltage of the first pull-down transistor Tdn1 and the threshold voltage of the fourth transistor T1_4 may increase.

Since the threshold voltage of the first pull-down transistor Tdn1 and the threshold voltage of the fourth transistor T1_4 increase, there may increase the amount of current flowing a line through which the first gate control voltage GVDD_odd is supplied to a gate node of the first pull-down transistor Tdn1 and a gate node of the fourth transistor T1_4.

Alternatively, there may occur a short circuit between a gate node and a source node of the transistor due to deterioration of the first pull-down transistor Tdn1 or the fourth transistor T1_4. In this case, there may increase the amount of current flowing through the line to which the first gate control voltage GVDD_odd is supplied due to the generation of the leakage current.

It is possible to sense the deterioration of the transistor controlled by the first QB node QB_odd by measuring the amount of current flowing through the line supplied with the first gate control voltage GVDD_odd.

In addition, it is possible to sense the deterioration of the transistor controlled by the second QB node QB_even by a method similar to the deterioration sensing method described above.

Referring to FIG. 6B, there may be measured the amount of current of a line supplied with the second gate control voltage GVDD_even during a period in which the second gate control voltage GVDD_even is the driving level.

In addition, it is possible to sense the deterioration of the transistor controlled by the second QB node QB_even based on the amount of current flowing through the line supplied with the second gate control voltage GVDD_even.

When the amount of current flowing through the line supplied with the first gate control voltage GVDD_odd become equal to or greater than a predetermined level, there may adjust a period in which the first gate control voltage GVDD_odd is the driving level. Accordingly, it is possible to increase the lifetime of the transistor controlled by the first QB node QB_odd.

In addition, when the amount of current flowing through the line supplied with the second gate control voltage GVDD_even become equal to or greater than a predetermined level, there may adjust the period in which the second gate control voltage GVDD_even is the driving level. Accordingly, it is possible to increase the lifetime of the transistor controlled by the second QB node QB_even.

Alternatively, based on the difference between the deterioration of the transistor controlled by the first QB node QB_odd and the deterioration of the transistor controlled by the second QB node QB_even, there may adjust the driving period of the first QB node QB_odd and the driving period of the second QB node QB_even.

Accordingly, it is possible to improve the lifetime and reliability of the gate circuit by increasing the overall lifetime of the transistor controlled by the first QB node QB_odd and the transistor controlled by the second QB node QB_even.

Figure 7:
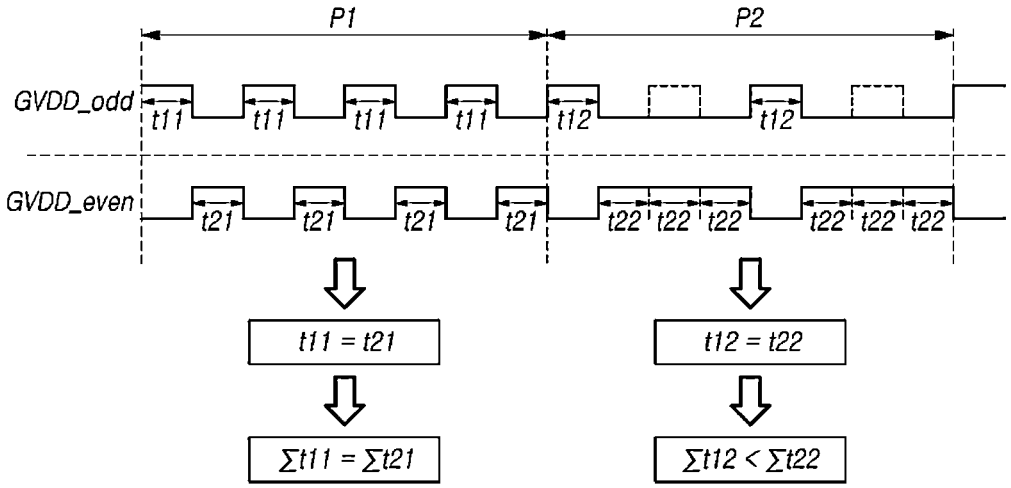
FIG. 7 illustrates another example of a driving method of the gate circuit shown in FIG. 3B.

FIG. 7 illustrates another example of a driving method of the gate circuit shown in FIG. 3B.

Referring to FIG. 7, in a first driving period P1, a period in which the first gate control voltage GVDD_odd is at the driving level and a period in which the second gate control voltage GVDD_even is at the driving level may alternate.

The length of the period in which the first gate control voltage GVDD_odd is the driving level may be t11.

The length of the period in which the second gate control voltage GVDD_even is the driving level may be t21. In this case, t21 may be the same as t11.

In the first driving period P1, the sum of the lengths of the period in which the first gate control voltage GVDD_odd is the driving level may be equal to the sum of the lengths of the period in which the second gate control voltage GVDD_even is the driving level.

Accordingly, in the first driving period P1, the length of the period in which the first QB node QB_odd is driven may be the same as the length of the period in which the second QB node QB_even is driven.

In the first driving period P1, there may be measured a first amount of current flowing the line supplied with the first gate control voltage GVDD_odd and a second amount of current flowing the line supplied with the second gate control voltage GVDD_even.

If the difference between the first amount of current and the second amount of current is equal to or greater than the set value, there may adjust the length of the period in which the first gate control voltage GVDD_odd is the driving level and the length of the period in which the second gate control voltage GVDD_even is the driving level.

For example, if the first amount of current is greater than the second amount of current, the length of the period in which the first gate control voltage GVDD_odd is the driving level may be reduced. In addition, the length of the period in which the second gate control voltage GVDD_even is the driving level may be increased.

As another example, if the first amount of current is smaller than the second amount of current, the length of the period during which the first gate control voltage GVDD_odd is the driving level may be increased. In addition, the length of the period in which the second gate control voltage GVDD_even is the driving level may be reduced.

FIG. 7 illustrates an example in which there are adjusted a period in which the first gate control voltage GVDD_odd is the driving level and a period in which the second gate control voltage GVDD_even is the driving level in the second driving period P2 when the first amount of current is greater than the second amount of current in the first driving period P1.

In the second driving period P2, there may be adjusted the number of alternating times between the period in which the first gate control voltage GVDD_odd is the driving level and the period in which the second gate control voltage GVDD_even is the driving level.

For example, in the second driving period P2, the period in which the first gate control voltage GVDD_odd is the driving level and the period in which the second gate control voltage GVDD_even is the driving level may be alternated in a ratio of 1:3.

In the second driving period P2, the length t12 of the period in which the first gate control voltage GVDD_odd is the driving level may be the same as the length t22 of the period in which the second gate control voltage GVDD_even is the driving level. However, since the number of alternations can be adjusted, in the second driving period P2, the sum of the lengths of the periods in which the first gate control voltage GVDD_odd is the driving level may be less than the sum of the lengths of the periods in which the second gate control voltage GVDD_even is the driving level.

In the second driving period P2, a degradation rate of the transistor driven by the first QB node QB_odd may be reduced. In the second driving period P2, the deterioration rate of the transistor driven by the second QB node QB_even may be relatively increased.

There may be reduced the difference between the deterioration of the transistor driven by the first QB node QB_odd and the deterioration of the transistor driven by the second QB node QB_even.

Accordingly, in the second driving period P2, a difference between a third amount of current flowing through the line supplied with the first gate control voltage GVDD_odd and the fourth amount of current flowing through the line supplied with the second gate control voltage GVDD_even may be less than or equal to the difference between the first amount of current and the second amount of current.

As described above, according to the difference between the degree of degradation of the transistor driven by the first QB node QB_odd and the degree of degradation of the transistor driven by the second QB node QB_even, the driving period of the first QB node QB_odd and the second QB node QB_even may be adjusted. Accordingly, it is possible to reduce the deterioration difference between the transistor driven by the first QB node QB_odd and the transistor driven by the second QB node QB_even, and increase the lifetime of the gate circuit.

Alternatively, there may be varied the length of the period in which the first gate control voltage GVDD_odd is the driving level and the period in which the second gate control voltage GVDD_even is the driving level. Accordingly, it is possible to reduce the deterioration difference between the transistor controlled by the first QB node QB_odd and the transistor controlled by the second QB node QB_even.

Figure 8A:
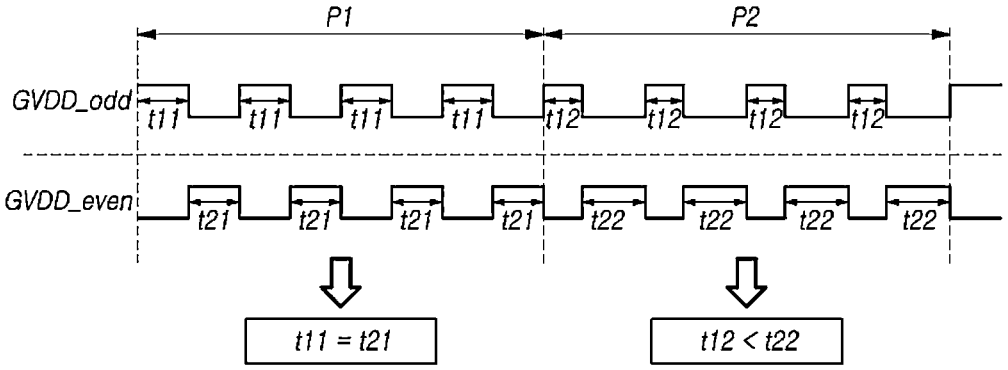
FIGS. 8A and 8B illustrate another example of a driving method of the gate circuit shown in FIG. 3B.
Figure 8B:
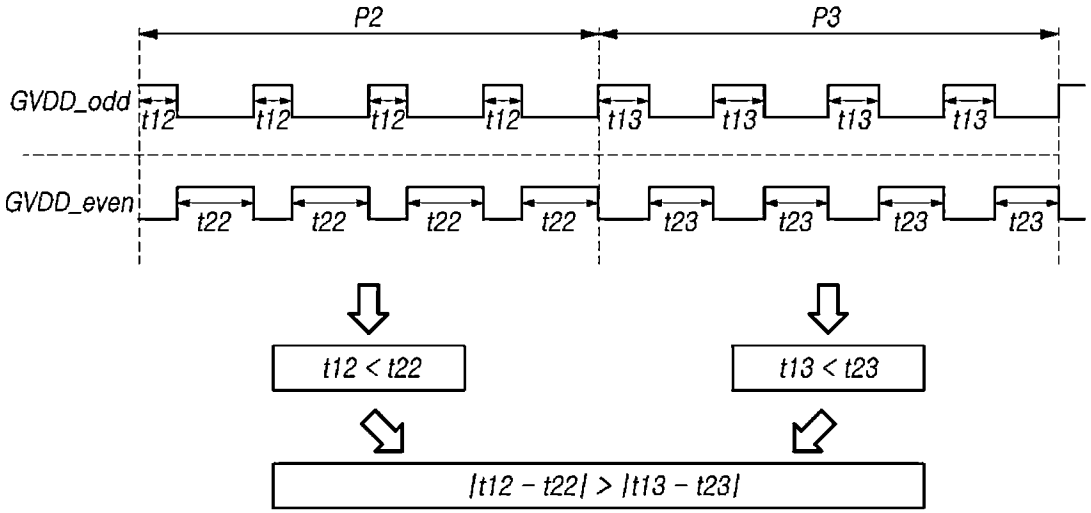

FIGS. 8A and 8B illustrate another example of a driving method of the gate circuit shown in FIG. 3B.

Referring to FIG. 8A, in the first driving period P1, there may be alternated a period in which the first gate control voltage GVDD_odd is the driving level and a period in which the second gate control voltage GVDD_even is the driving level.

In the first driving period P1, the length t11 of the period in which the first gate control voltage GVDD_odd is the driving level may be the same as the length t21 of the period in which the second gate control voltage GVDD_even is the driving level.

In the first driving period P1, according to the first amount of current flowing through the line supplied with the first gate control voltage GVDD_odd and the second amount of current flowing through the line supplied with the second gate control voltage GVDD_even, there may be adjusted the period in which the first gate control voltage GVDD_odd is the driving level and the period in which the second gate control voltage GVDD_even is the driving level.

For example, if the first amount of current is greater than the second amount of current, the length of the period in which the first gate control voltage GVDD_odd is the driving level may be reduced. In addition, the length of the period in which the second gate control voltage GVDD_even is the driving level may be increased.

In the second driving period P2, the length t12 of the period in which the first gate control voltage GVDD_odd is the driving level may be less than the length t22 of the period in which the second gate control voltage GVDD_even is the driving level.

In the second driving period P2, there may be decreased the difference between a third amount of current flowing through the line supplied with the first gate control voltage GVDD_odd and the fourth amount of current flowing through the line supplied with the second gate control voltage GVDD_even.

For example, the difference between the third amount of current and the fourth amount of current may be less than or equal to the difference between the first amount of current and the second amount of current.

If there is a difference between the third amount of current and the fourth amount of current in the second driving period P2, the period in which the first gate control voltage GVDD_odd is the driving level may be reduced, and the period in which the second gate control voltage GVDD_even is the driving level may maintain an increased state.

Alternatively, even if the third amount of current is greater than the fourth amount of current, if the difference between the third amount of current and the fourth amount of current is smaller than the set value, there may be adjusted the period in which the first gate control voltage GVDD_odd is the driving level and the period in which the second gate control voltage GVDD_even is the driving level.

Referring to FIG. 8B, the length t13 of a period in which the first gate control voltage GVDD_odd is the driving level in a third driving period P3 after the second driving period P2 may be greater than the length t12 of a period in which the first gate control voltage GVDD_odd is the driving level in the second driving period P2.

The length t23 of a period in which the second gate control voltage GVDD_even is the driving level in the third driving period P3 may be smaller than the length t22 of a period in which the second gate control voltage GVDD_even is the driving level in the second driving period P2.

While maintaining a state in which the length t23 of the period in which the second gate control voltage GVDD_even is the driving level in the third driving period P3 is greater than the length t13 of the period in which the first gate control voltage GVDD_odd is the driving level, there may be reduced a difference between the period in which the first gate control voltage GVDD_odd is the driving level and the period in which the second gate control voltage GVDD_even is the driving level.

The difference between the amount of current flowing through the line supplied with the first gate control voltage GVDD_odd and the amount of current flowing through the line supplied with the second gate control voltage GVDD_even in the third driving period P3 may be less than or equal to a difference between the first amount of current and the second amount of current measured in the first driving period P1. Furthermore, it may be less than or equal to the difference between the third amount of current and the fourth amount of current measured in the second driving period P2.

While reducing a deterioration deviation between the transistor controlled by the first QB node QB_odd and the transistor controlled by the second QB node QB_even, it is possible to drive the first QB node QB_odd and the second QB node QB_even while minimizing the difference between the driving periods.

Alternatively, in the case that the deterioration difference between the transistor controlled by the first QB node QB_odd and the transistor controlled by the second QB node QB_even is large, only the first QB node QB_odd may be driven or only the second QB node QB_even may be driven for a specific period.

In addition, in some cases, in the case that the transistor controlled by the first QB node QB_odd is damaged or the transistor controlled by the second QB node QB_even is damaged, only the first QB node QB_odd may be driven or only the second QB node QB_even may be driven.

If the transistor controlled by the first QB node QB_odd or the second QB node QB_even is damaged, the amount of current measured may greatly increase due to the leakage current. Accordingly, if the amount of current measured is equal to or greater than the threshold value, considering that the transistor is damaged, only one of the first QB node QB_odd and the second QB node QB_even is driven to increase the lifetime of the gate circuit.

As described above, in the embodiments of the present disclosure, there may measure the amount of current flowing through the line supplied with the first gate control voltage GVDD_odd controlling the first QB node QB_odd and the amount of current flowing through the line supplied with the second gate control voltage GVDD_even controlling the second QB node QB_even, and there may sense the deterioration of a device or an element in the gate circuit. Further, it is possible to improve the lifespan and reliability of the gate circuit by adjusting the driving period of the first QB node QB_odd and the driving period of the second QB node QB_even.

The measurement of the amount of current of the line supplied with the first gate control voltage GVDD_odd and the line supplied with the second gate control voltage GVDD_even may be performed by a configuration additionally included in the display device 100, or may be performed by a configuration already included in the display device 100.

Figure 9A:
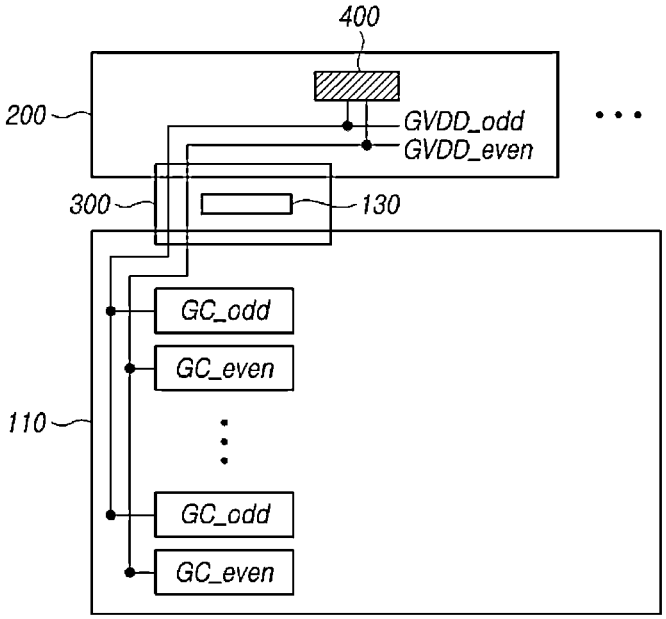
FIGS. 9A and 9B illustrate examples of an arrangement structure of a configuration for sensing deterioration of a device included in the gate circuit shown in FIG. 3B.
Figure 9B:
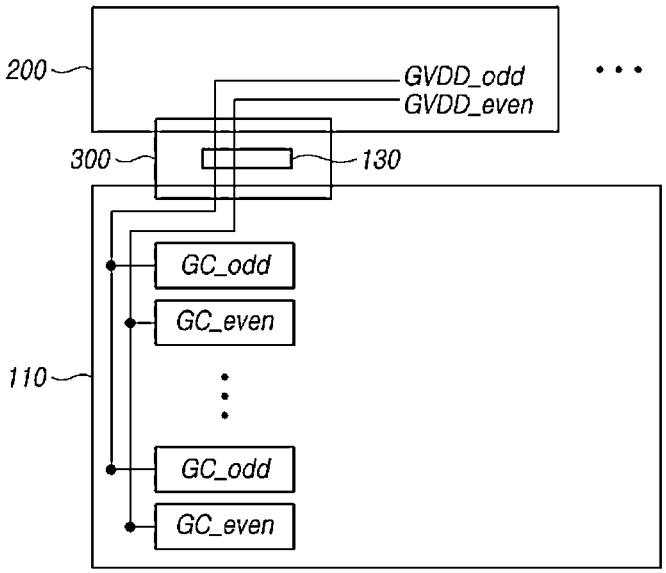

FIGS. 9A and 9B illustrate examples of an arrangement structure of a configuration for sensing deterioration of a device included in the gate circuit shown in FIG. 3B.

Referring to FIG. 9A, the line supplying the first gate control voltage GVDD_odd and the second gate control voltage GVDD_even to the first gate circuit GC_odd and the second gate circuit GC_even disposed on the display panel 110 may be disposed on one side of the display panel 110.

In addition, a part of the line supplying the first gate control voltage GVDD_odd and the second gate control voltage GVDD_even may be disposed on a flexible film 300 on which a source printed circuit board 200 and a data driving circuit 130 are mounted.

A current sensing unit 400 electrically connected to the line supplying the first gate control voltage GVDD_odd and the second gate control voltage GVDD_even may be disposed on, for example, the source printed circuit board 200.

The current sensing unit 400 may monitor the amount of current flowing through the line supplied with the first gate control voltage GVDD_odd and the second gate control voltage GVDD_even, and there may be adjusted the period in which the first gate control voltage GVDD_odd is at the driving level and the period in which the second gate control voltage GVDD_even is the driving level.

In order to monitor the amount of current flowing through the line supplied with the first gate control voltage GVDD_odd and the second gate control voltage GVDD_even, there may be utilized configuration already included in the display device 100.

Referring to FIG. 9B, a line supplying the first gate control voltage GVDD_odd and the second gate control voltage GVDD_even may be electrically connected to the data driving circuit 130.

The data driving circuit 130 may include a configuration that performs sensing to detect deterioration of the subpixels SP disposed on the display panel 110. For example, the data driving circuit 130 may include an integrator, a sample and hold circuit, and an analog-to-digital converter.

The amount of current flowing through the line supplied with the first gate control voltage GVDD_odd and the line supplied with the second gate control voltage GVDD_even may be measured by using the integrator included in the data driving circuit 130.

Accordingly, without adding a separate configuration, there may monitor the amount of current flowing through the line supplied with the first gate control voltage GVDD_odd and the second gate control voltage GVDD_even, and may adjust the driving period of the first QB node QB_odd and the driving period of the second QB node QB_even included in the gate circuit.

Figure 10:
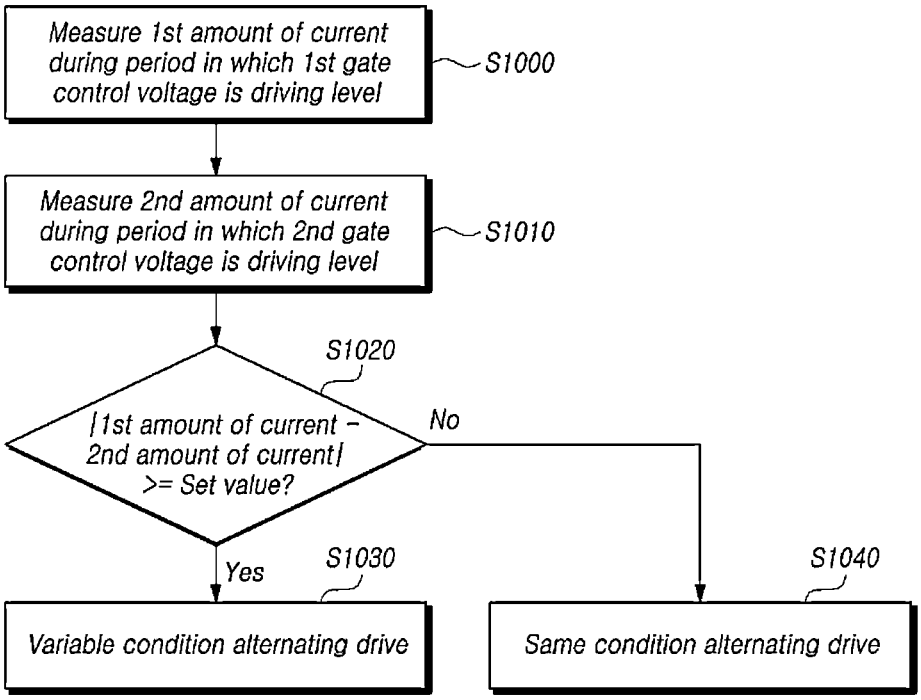
FIG. 10 illustrates an example of a process of a method of driving a display device according to embodiments of the present disclosure.

FIG. 10 illustrates an example of a process of a method of driving a display device 100 according to embodiments of the present disclosure.

Referring to FIG. 10, the display device 100 may measure the first amount of current flowing through the line supplied with the first gate control voltage GVDD_odd during the period in which the first gate control voltage GVDD_odd supplied to the gate driving circuit 120 is at the driving level (S1000).

The display device 100 may measure the second amount of current flowing through the line supplied with the second gate control voltage GVDD_even during the period in which the second gate control voltage GVDD_even supplied to the gate driving circuit 120 is at the driving level (S1010).

The display device 100 may determine whether a difference between the first amount of current and the second amount of current is equal to or greater than a set value (S1020).

If the difference between the first amount of current and the second amount of current is equal to or greater than the set value, the display device 100 may drive the gate driving circuit 120 by variably adjusting the length of the period in which the first gate control voltage GVDD_odd is the driving level and the length of the period in which the second gate control voltage GVDD_even is the driving level (S1030).

For example, if the difference between the first amount of current and the second amount of current is equal to or greater than the set value and the first amount of current is greater than the second amount of current, the display device may reduce the period in which the first gate control voltage GVDD_odd is the driving level, and may increase the period in which the second gate control voltage GVDD_even is the driving level by adjusting the number of alternating or the length of the driving period.

As another example, if the difference between the first amount of current and the second amount of current is equal to or greater than the set value and the first amount of current is smaller than the second amount of current, the period in which the first gate control voltage GVDD_odd is the driving level may be increased and the period in which the second gate control voltage GVDD_even is the driving level may be reduced.

If the difference between the first amount of current and the second amount of current is less than the set value, the display device 100 may maintain the period in which the first gate control voltage GVDD_odd is the driving level and the period in which the second gate control voltage GVDD_even is the driving level the same, and may alternately drive the first QB node QB_odd and the second QB node QB_even (S1040).

According to the above-described embodiments of the present disclosure, it is possible to reduce deterioration of a transistor included in the gate circuit and improve the lifespan of the gate circuit by alternately driving the first QB node QB_odd and the second QB node QB_even included in the gate circuit.

Further, by monitoring the amount of current of the line supplied with the first gate control voltage GVDD_odd for driving control of the first QB node QB_odd and the amount of current of the line supplied with the second gate control voltage GVDD_even for driving control of the second QB node QB_even, there may sense the difference between the deterioration of the transistor controlled by the first QB node QB_odd and the deterioration of the transistor controlled by the second QB node QB_even.

Based on the difference between the deterioration of the transistor controlled by the first QB node QB_odd and the deterioration of the transistor controlled by the second QB node QB_even, it is possible to maximize or at least increase the lifetime of the gate circuit and improve the reliability by variably adjusting the driving period of the first QB node QB_odd and the second QB node QB_even to optimize the driving of the first QB node QB_odd and the second QB node QB_even.

It will be apparent to those skilled in the art that various modifications and variations can be made in the gate driving circuit, the display device, and the method for driving a display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a plurality of subpixels disposed on a display panel;

a plurality of gate lines electrically connected to a part of the plurality of subpixels; and a plurality of gate circuits for driving the plurality of gate lines, wherein each of the plurality of gate circuits comprises a pull-up transistor controlled by a Q node, a first pull-down transistor controlled by a first QB node, and a second pull-down transistor controlled by a second QB node, wherein the first QB node is electrically connected to an input terminal of a first gate control voltage, and the second QB node is electrically connected to an input terminal of a second gate control voltage, wherein, in a first driving period, a length of a period in which the first gate control voltage is a driving level is equal to a length of a period in which the second gate control voltage is the driving level, and, in a second driving period, a length of a period in which the first gate control voltage is the driving level is different from a length of a period in which the second gate control voltage is the driving level.

2. The display device of claim 1, wherein, in the first driving period, an amount of current flowing through a line supplied with the first gate control voltage during the period in which the first gate control voltage is the driving level is greater than an amount of current flowing through a line supplied with the second gate control voltage during the period in which the second gate control voltage is the driving level, and, in the second driving period, the length of the period in which the first gate control voltage is the driving level is smaller than the length of the period in which the second gate control voltage is the driving level.

3. The display device of claim 1, wherein, in the first driving period, an amount of current flowing through a line supplied with the first gate control voltage during the period in which the first gate control voltage is the driving level is smaller than an amount of current flowing through a line supplied with the second gate control voltage during the period in which the second gate control voltage is the driving level, and, in the second driving period, the length of the period in which the first gate control voltage is the driving level is greater than the length of the period in which the second gate control voltage is the driving level.

4. The display device of claim 1, wherein a difference, in the second driving period, between an amount of current flowing through a line supplied with the first gate control voltage during the period in which the first gate control voltage is the driving level and an amount of current flowing through a line supplied with the second gate control voltage during the period in which the second gate control voltage is the driving level is less than or equal to a difference, in the first driving period, between an amount of current flowing through a line supplied with the first gate control voltage during the period in which the first gate control voltage is the driving level and an amount of current flowing through a line supplied with the second gate control voltage during the period in which the second gate control voltage is the driving level.

5. The display device of claim 1, wherein a difference, in a third driving period after the second driving period, between an amount of current flowing through a line supplied with the first gate control voltage during the period in which the first gate control voltage is the driving level and an amount of current flowing through a line supplied with the second gate control voltage during the period in which the second gate control voltage is the driving level is less than or equal to a difference, in at least one of the first driving period and the second driving period, between an amount of current flowing through a line supplied with the first gate control voltage during the period in which the first gate control voltage is the driving level and an amount of current flowing through a line supplied with the second gate control voltage during the period in which the second gate control voltage is the driving level.

6. The display device of claim 5, wherein a difference, in the third driving period, between a length of a period in which the first gate control voltage is the driving level and a length of a period in which the second gate control voltage is the driving level is less than or equal to a difference, in the second driving period, between a length of a period in which the first gate control voltage is the driving level and a length of a period in which the second gate control voltage is the driving level.

7. The display device of claim 1, wherein, in the second driving period, one of the first gate control voltage and the second gate control voltage maintains the driving level and the other maintains a non-driving level.

8. The display device of claim 1, wherein a line supplied with the first gate control voltage and a line supplied with the second gate control voltage are electrically connected to a data driving circuit supplying a data voltage to the plurality of subpixels.

9. The display device of claim 1, wherein the second gate control voltage is at a non-driving level during a period in which the first gate control voltage is the driving level, and the second gate control voltage is at the driving level during a period in which the first gate control voltage is at the non-driving level.

10. The display device of claim 1, wherein the first QB node is at a turn-off level during a period in which the first gate control voltage is the driving level and is at a turn-on level in the remaining period, and the second QB node is at a turn-off level during a period in which the first gate control voltage is the driving level.

11. The display device of claim 10, wherein a length of a period in which the first QB node is at the turn-on level, during the period in which the first gate control voltage is the driving level, is greater than a length of a period in which the first QB node is at the turn-off level.

12. The display device of claim 1, wherein the second pull-down transistor is electrically connected between a source node and a drain node of the first pull-down transistor.

13. The display device of claim 1, wherein the Q node is separately located in each of the plurality of gate circuits, and the first QB node and the second QB node are shared by two adjacent gate circuits among the plurality of gate circuits.

14. A method for driving a display device, comprising:

supplying a first gate control voltage of a driving level to a gate driving circuit during a part of a first driving period and supplying a second gate control voltage of a driving level to the gate driving circuit during the remaining period of the first driving period;

measuring a first amount of current flowing through a line supplied with the first gate control voltage during a period in which the first gate control voltage is at the driving level in the first driving period;

measuring a second amount of current flowing through a line supplied with the second gate control voltage during a period in which the second gate control voltage is at the driving level in the first driving period; and adjusting, based on a comparison result of the first amount of current and the second amount of current, a length of a period in which the first gate control voltage supplied to the gate driving circuit is at a driving level and a length of a period in which the second gate control voltage is at a driving level in a second driving period after the first driving period.

15. The method of claim 14, further comprising:

measuring a third amount of current flowing through a line supplied with the first gate control voltage during a period in which the first gate control voltage is at the driving level in the second driving period; and measuring a fourth amount of current flowing through a line supplied with the second gate control voltage during a period in which the second gate control voltage is at the driving level in the second driving period, wherein a difference between the third amount of current and the fourth amount of current is less than or equal to a difference between the first amount of current and the second amount of current.

16. The method of claim 14, wherein the adjusting comprises adjusting, if a difference between the first amount of current and the second amount of current is greater than or equal to a preset value, the length of the period in which the first gate control voltage supplied to the gate driving circuit is at the driving level and the length of the period in which the second gate control voltage is at the driving level in the second driving period.

17. The method of claim 16, wherein the adjusting comprises, if the first amount of current is greater than the second amount of current, reducing the length of the period in which the first gate control voltage supplied to the gate driving circuit is at the driving level in the second driving period and increasing the length of the period in which the second gate control voltage is at the driving level in the second driving period, and, if the first amount of current is smaller than the second amount of current, increasing the length of the period in which the first gate control voltage supplied to the gate driving circuit is at the driving level in the second driving period and reducing the length of the period in which the second gate control voltage is at the driving level in the second driving period.

18. A gate driving circuit, comprising:

a first gate circuit including a pull-up transistor controlled by a Q1 node, a first pull-down transistor controlled by a first QB node, and a second pull-down transistor controlled by a second QB node; and a second gate circuit including a pull-up transistor controlled by a Q2 node, a first pull-down transistor controlled by the first QB node, and a second pull-down transistor controlled by the second QB node, wherein the first QB node is controlled by a first gate control voltage, and the second QB node is controlled by a second gate control voltage, and wherein a period in which the first gate control voltage is at a driving level and a period in which the second gate control voltage is at a driving level alternate.

19. The gate driving circuit of claim 18, wherein, in a first driving period, a length of a period in which the first gate control voltage is a driving level is equal to a length of a period in which the second gate control voltage is the driving level, and, in a second driving period, a length of a period in which the first gate control voltage is the driving level is different from a length of a period in which the second gate control voltage is the driving level.

20. The gate driving circuit of claim 18, wherein a level of the first QB node and a level of the second QB node are different during a period in which both the Q1 node and the Q2 node are at a turn-off level.

* * * * *